US009353467B2

(12) United States Patent
Stang

(10) Patent No.: US 9,353,467 B2
(45) Date of Patent: May 31, 2016

(54) SHUTTLE AS WELL AS WEAVING MACHINE AND WEAVING PROCESS WITH SUCH A SHUTTLE

(71) Applicant: Mageba Textilmaschinen GmbH & Co. KG, Bernkastel-Kues (DE)

(72) Inventor: Oliver Alexander Stang, Bernkastel-Kues (DE)

(73) Assignee: MAGEBA TEXTILMASCHINEN GMBH & CO. KG, Bernkastel-Kues (DE)

( * ) Notice: Subject to any disclaimer, the term of this patent is extended or adjusted under 35 U.S.C. 154(b) by 0 days.

(21) Appl. No.: 14/161,479

(22) Filed: Jan. 22, 2014

(65) Prior Publication Data

US 2014/0202578 A1 Jul. 24, 2014

(30) Foreign Application Priority Data

Jan. 22, 2013 (DE) ..... 183 90 889

(51) Int. Cl.

| | |
|---|---|
| ***D03D 47/27*** | (2006.01) |
| ***D03D 47/26*** | (2006.01) |
| ***D03D 49/46*** | (2006.01) |
| ***D03J 5/08*** | (2006.01) |
| *D03D 49/50* | (2006.01) |

(52) U.S. Cl.

CPC ..... *D03D 47/267* (2013.01); *D03D 49/46* (2013.01); *D03J 5/08* (2013.01)

(58) Field of Classification Search

CPC ..... D03D 49/44; D03D 2700/101; D03D 2700/1472; D03D 2700/162; D03D 41/00; D03D 45/50; D03D 47/345; D03D 47/36; B65H 51/20; D03J 5/00

USPC ..... 139/438, 196.2, 224 R, 450, 452, 1 R, 139/134, 136, 144, 196.3, 213, 224 A, 247, 139/256 R, 336, 439, 443, 453; 242/365.1

See application file for complete search history.

(56) References Cited

U.S. PATENT DOCUMENTS

| | | | | | |
|---|---|---|---|---|---|
| 3,563,279 | A | * | 2/1971 | Malchair | 139/457 |
| 3,568,727 | A | * | 3/1971 | Wilde et al. | 139/336 |
| 3,603,352 | A | * | 9/1971 | Golobart | 139/443 |
| 3,724,508 | A | * | 4/1973 | Jekl et al. | 139/436 |
| 3,732,896 | A | * | 5/1973 | Jekl et al. | 139/436 |
| 3,771,572 | A | * | 11/1973 | Gross | 139/136 |
| 3,788,362 | A | * | 1/1974 | Blakely | 139/247 |
| 3,882,904 | A | * | 5/1975 | Bergner | 139/213 |
| 4,068,686 | A | * | 1/1978 | Svaty | 139/438 |
| 4,076,052 | A | * | 2/1978 | Demuth et al. | 139/439 |
| 4,313,472 | A | * | 2/1982 | Weidmann | 139/370.2 |
| 4,529,016 | A | * | 7/1985 | Schlecht et al. | 139/438 |
| 4,986,316 | A | * | 1/1991 | Morohashi et al. | 139/452 |

FOREIGN PATENT DOCUMENTS

| | | |
|---|---|---|
| DE | 19942414 | 3/2004 |
| EP | 1749913 | 2/2007 |

* cited by examiner

*Primary Examiner* — Bobby Muromoto, Jr.

(74) *Attorney, Agent, or Firm* — Lowe Graham Jones PLLC

(57) ABSTRACT

The invention relates to a shuttle for a weaving machine, of which the shuttle is designed to be alternately transferred from one side of a weave to the other while machine-side guiding elements are constantly intervening, with a left-hand connecting element and a right-hand connecting element for connecting the shuttle to the corresponding transfer element and to a filling (weft) bobbin. The filling bobbin is embodied to be rotationally positively drivable, with a drive that is designed for at least two impingements upon the filling bobbin, namely for either accelerating or for decelerating the dispensing of filling (weft) thread. The invention further relates to a weaving process in which such a shuttle is used.

21 Claims, 3 Drawing Sheets

SHUTTLE AS WELL AS WEAVING MACHINE AND WEAVING PROCESS WITH SUCH A SHUTTLE

PRIORITY CLAIM

This application claims priority to German Application No. 18390889, which was filed on Jan. 22, 2013.

FIELD OF THE INVENTION

The invention relates generally to a shuttle for a weaving machine and, in particular, for a shuttle weaving machine for manufacturing a fabric with woven selvedges on both sides, as well as for a weaving process, and a weaving machine with such a shuttle.

BACKGROUND

Conforming to this genre are shuttles that carry the entire filling thread supply in order to lay the latter multiple times, alternating between the warp thread. Such a shuttle may, e.g., be found in EP 1 749 913 B1.

In known weaving machines, such shuttles are driven by means of drive elements arranged laterally next to the shed; such drives are, at a minimum, able to accelerate and decelerate the shuttle. Often, the shuttle is freewheeling between the machine sides, during which time the shuttle is neither guided nor picked up by any machine member of the weaving machine. The filling thread is unreeled by means of the shuttle's movement, with sometimes elaborate measures to compensate for free lengths of filling thread. In such shuttles, the filling thread is wound onto special filling bobbins.

It is not only during insertion of the filling thread for manufacturing wide weaves that controlling the filling thread poses a problem; due to rising quality requirements this is also the case in case of narrow weaves. Often in known processes, the filling thread is under too much strain or woven sloppily because the filling thread has been unreeled in an uncontrolled manner, or too much deceleration has been applied.

SUMMARY OF THE INVENTION

The invention relates to a shuttle (10) for a weaving machine, of which the shuttle is designed to be alternately transferred from one side of a weave to the other while machine-side guiding elements are constantly intervening, with a left-hand connecting element (15) and a right-hand connecting element (16) for connecting the shuttle (10) to the corresponding transfer element and to a filling (weft) bobbin (12).

According to this invention, the filling bobbin (12) is embodied to be rotationally positively drivable, with a drive (30) that is designed for at least two impingements upon the filling bobbin, namely for either accelerating or for decelerating the dispensing of filling (weft) thread.

The invention further relates to a weaving process in which such a shuttle is used.

More specifically, the shuttle, which carries a filling bobbin through a shed, is, during the alternate transfer from one side of the weaving machine to the other, in constant contact with at least one machine member of the weaving machine, during a transfer period with a left-hand and a right-hand transfer element. The filling bobbin supplies the filling thread that must be alternately laid through the shed between the sides of the machine.

The present invention is directed to make the weaving process and/or, respectively, the machine members of the weaving machine more economical, and/or to improve the quality of the weave. A shuttle according to the invention in a first embodiment possesses a filling bobbin that is embodied to be positively drivable, drivable with a drive destined for at least two impingements upon the filling bobbin; namely, to either accelerate or decelerate the filling thread feed. Such a drive allows using standardized filling thread bobbins, in particular, for receiving a commercial thread or roving bobbin having a cardboard or plastic core, thus avoiding rewinding processes. This prevents any potentially resulting damage to the yarn or other wound materials. As the unwinding process is controlled by the drive, there is no need for elaborate thread compensators or braking systems. It is even possible to implement preventive process steps or flows where once, the only option used to be reacting to shuttle movements. Controlled interaction between the shuttle drive and the filling bobbin drive is possible. For example, according to a process according to the invention, the filling bobbin is accelerated in anticipation in order to avoid high thread tension during the shuttle's acceleration phase. This allows handling large amounts of filling thread.

According to an advantageous embodiment of the shuttle according to the invention, the drive is arranged as the, specifically, sole drive, stationarily mounted on the shuttle. Alternately, a drive for the filling bobbin is arranged on each one of the transfer elements.

According to another advantageous embodiment of the shuttle according to the invention, the drive is embodied as an electric servo drive or a pneumatic drive; in particular, as a friction wheel drive. Such drives are cost-efficiently available and easily integrated into controllers.

Using force-fitting drive train components allows for simple compensation of small differences in filling thread length; e.g., by means of a reduction in filling bobbin diameter.

According to another advantageous embodiment of the shuttle according to the invention, the filling bobbin possesses a yarn bobbin holder to receive a standardized filling bobbin, which holder—according to one embodiment—is also radially drivable from the inside in a friction-fit manner.

According to another advantageous embodiment of the shuttle according to the invention, the drive for the shuttle impinges directly and thus, transferring torque, specifically, in a torque-controlled manner—upon a friction wheel or a sleeve. The friction wheel preferably runs, at least temporarily, on a roller of the filling bobbin. Alternately, the sleeve will receive the yarn bobbin holder for transferring momentum in the coaxial direction; in particular, without mechanical intervention. For safety purposes, this allows blocking the filling thread without the drive breaking the filling thread.

According to another advantageous embodiment of the shuttle according to the invention, the connecting elements are embodied as a single slide having internal guide bores aligned in the direction of the filling thread for receiving a guide device that guides the tension roller so that it is movable in the direction of filling thread insertion.

According to another advantageous embodiment of the shuttle according to the invention, the rotational axis of the tension roller is aligned in the direction of the warp thread. Here, it is particularly preferable for the filling thread to pass through a slot through a housing surrounding at least the filling bobbin at least for part of its circumference. If the tension roller is aligned in the direction of the warp thread, band-shaped yarns will unreel into the fabric without twisting.

The shuttle according to the invention according to an alternative embodiment possesses a filling bobbin aligned with the direction of the warp threads, with the shuttle according to the first variant preferably also having a filling bobbin aligned with the direction of the warp threads. This alignment is especially advantageous when weaving so-called carbon rovings as it completely prevents deflection and twisting. The advantage of the filling bobbin alignment alone is sufficient with regard to quality standards; it may even obviate the need for a drive according to the first variant. Additionally, the alignment of the tension roller with the direction of the warp threads is advantageous for automatic bobbin changing due to better accessibility.

A weaving machine equipped with a shuttle according to the invention preferably controls the shuttle drive as a function of filling thread tension measured through the filling bobbin, or as a function of travel/time presets. A weaving process according to the invention also preferably controls the shuttle drive as a function of filling thread tension.

BRIEF DESCRIPTION OF THE DRAWINGS

Preferred and alternative examples of the present invention are described in detail below with reference to the following drawings. Identical components have been marked with the same references in both exemplary embodiments. References have not been entered in all the FIGURES to avoid clutter.

DETAILED DESCRIPTION OF THE PREFERRED EMBODIMENT

Figure 1:
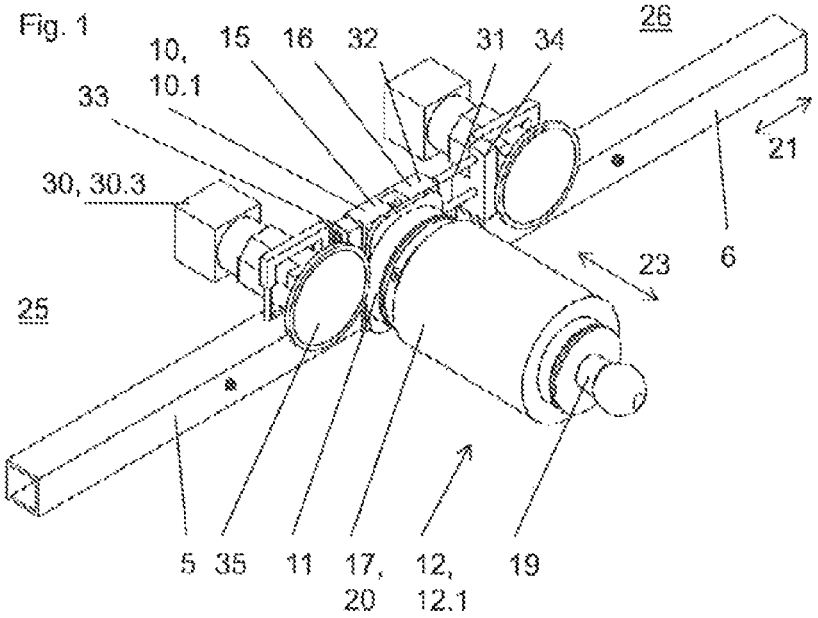
FIG. 1 is a perspective view of first exemplary embodiment of a shuttle according to the present invention with a filling bobbin aligned in the direction of the warp thread, shown partially installed, between two friction wheel drives arranged on transfer elements of the weaving machine.
Figure 2:
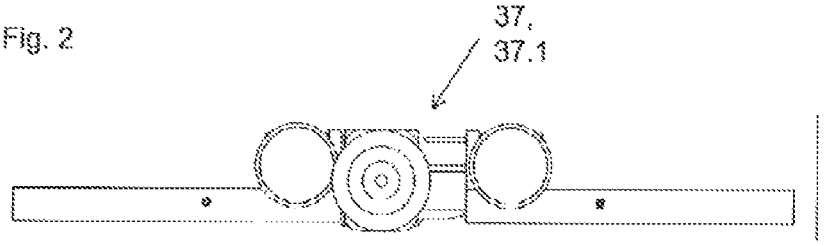
FIG. 2 is a side view of the shuttle from FIG. 1.

FIGS. 1 and 2 show a first exemplary embodiment of a shuttle 10, 10.1 according to the invention with a filling thread bobbin 12, 12.1 aligned in the direction of warp thread 23. Filling thread bobbin 12.1 is unilaterally attached to a slide 32 with an axis 19 so that a standardized filling yarn bobbin 17 that is rotatably arranged thereupon can be unreeled. Filling yarn bobbin 17 can be drawn off into a free working space, allowing an automated exchange of such filling yarn bobbins.

Slide 32 is always generally received by at least one transfer element 5, 6 of a weaving machine, whose details have been omitted from the illustration, slidable in the direction of filling thread insertion 21, because as usual, if specific qualities and process reliabilities have been specified, a transfer across a gap 37, 37.1 must be warranted while at least one weaving machine member is engaged. Facing shuttle 10, transfer elements 5, 6 possess stops 33, 34 against the latter of which the shuttle may preferably be locked, e.g. magnetically, after the transfer from a first machine side 25 to a second machine side 26 has been completed.

Facing slide 32, filling bobbin 12.1 possesses a rotor 11 that rotates together with the bobbin, i.e., that can receive a torque and transfer it to the filling bobbin. To the left and right of filling bobbin 12.1, friction wheel drives 30, 30.3 are installed on transfer elements 5, 6 to provide rolling contact to rotor 11. Then, friction wheels 35 driven by friction wheel drives 30.3 will be in contact with rotor 11 and will be able to transfer a torque, which is controlled, in particular, as a function of filling thread tension or according to travel/time specifications, to the filling bobbin when slide 32 is secured against one of stops 33, 34.

Between stops 33, 34 on the machine-side, a guide device 31 arranged on the shuttle-side ends of transfer elements 5, 6 carries slide 32. Facing left stop 33, slide 32 comprises a left-hand connecting element 15 with a corresponding receiving device.

On the right-hand side, the slide possesses another receiving device of a right-hand connecting element 16, which reception device mates with a right-hand transfer element 6. Guide element 31 comprises, according to the first exemplary embodiment, pins guided in a form-fitting manner in the guide bores of slide 32 when slide 32 is moved. Pins and guide bores are aligned in the direction of filling thread insertion.

Filling bobbin 12.1 possesses a yarn bobbin holder 18 that is rotatable on axis 19 and serves to receive a standardized filling thread bobbin 17 supplying filling thread 20. In particular, as a success of the invention, commercial yarn and/or roving bobbins having a cardboard or plastic core can be received and reeled off in a controlled manner. This obviates the need for thread compensators and or deflection devices, as well as the other rewinding processes required for known shuttles.

Figure 3:
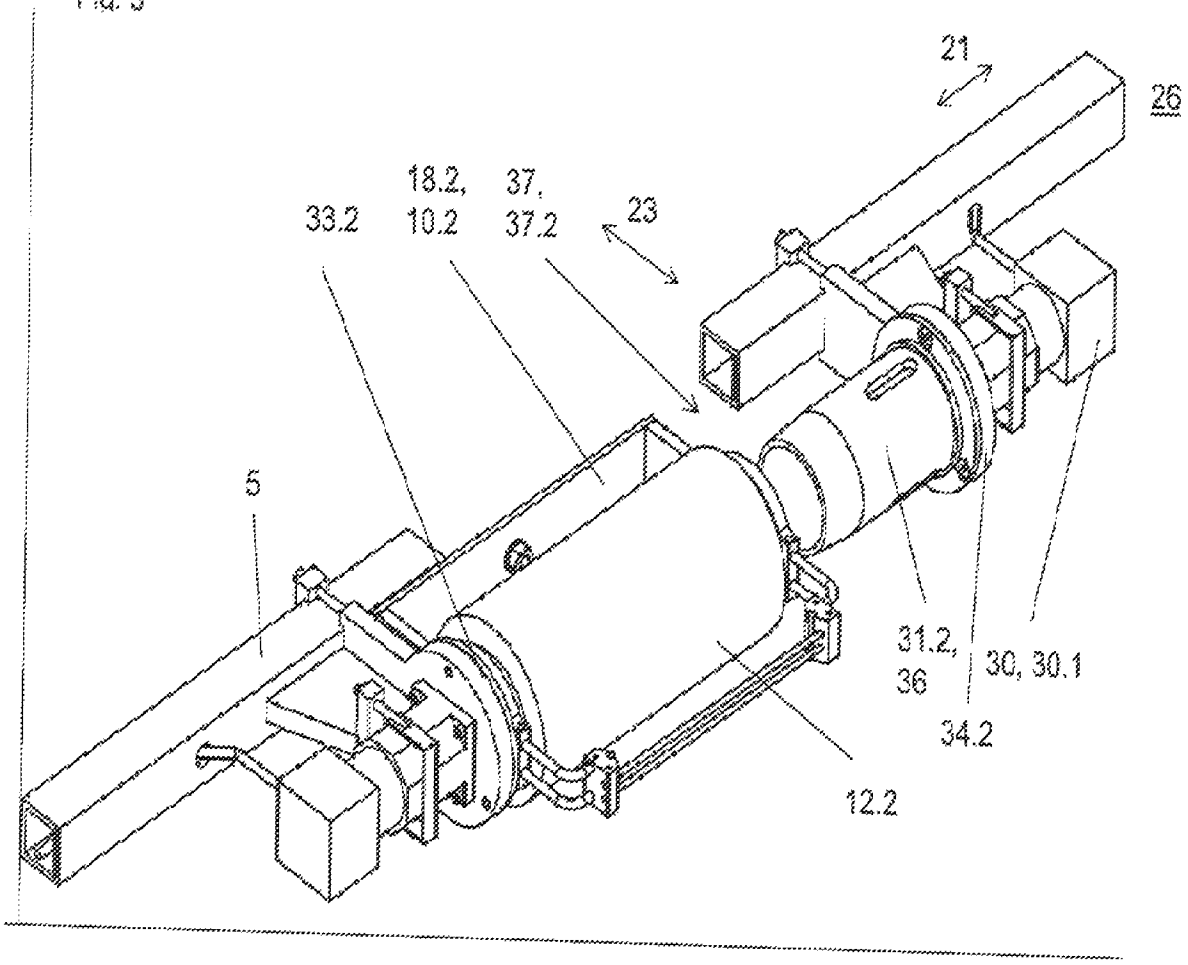
FIG. 3 is a perspective view of a second exemplary embodiment of a shuttle according to the present invention, with a filling bobbin aligned in the direction of filling thread insertion.

FIG. 3 shows a second exemplary embodiment of a shuttle 10.2 according to the invention that can receive a filling thread bobbin 12.2 aligned in the direction of filling thread insertion 21. Filling thread bobbin 12.2 with its single yarn bobbin holder 18.2 alternates between a left-hand 25 and a right-hand 26 sleeve 36 when the direction of movement of shuttle 10.2 changes.

Sleeves 36 are arranged on the ends of transfer elements 5, 6 facing shuttle 10.2 and possess stops 33.2, 34.2 that face the corresponding machine side, against which stops the received filling thread bobbin 12.2 can be locked, at least indirectly. i.e., sleeves 36 are to be understood as another form of a guide device 31.2 that must transfer shuttle 10.2 across gap 37, 37.2 while constantly guiding it. Sleeves 36 are driven in a force-fitting manner by one servo drive 30.1 each arranged on the corresponding transfer element 5,6.

Figure 4:
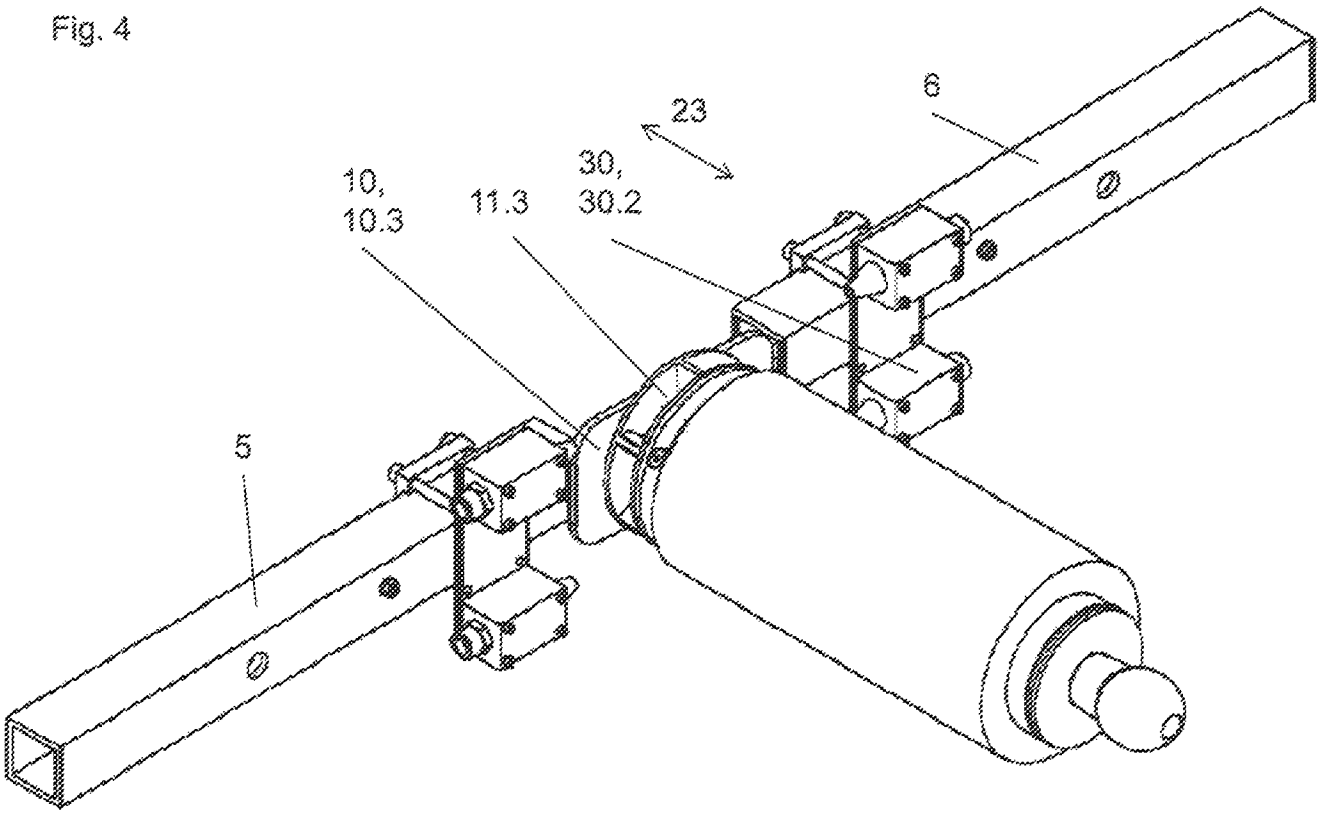
FIG. 4 is a perspective view of a third exemplary embodiment of a shuttle according to the present invention, with a pneumatically driven shuttle.

FIG. 4 shows a third exemplary embodiment of a shuttle 10, 10.3 according to the invention that is comparable to the first exemplary embodiment. The difference lies specifically in the embodiment of drive 30, here as a pneumatic drive 30.2.

As drives, transfer elements 5, 6 now bear jets that face slide 32.3 and are directed at an air rotor 11.3, through which jets an air stream that can be directed at the blades of air rotor 11.3, depending on whether the objective is to accelerate or to decelerate filling bobbin 12.3.

This embodiment would be usable in explosion-protected locations or environments.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. A shuttle weaving machine, comprising:

a shuttle;

a shuttle drive configured to alternately transfer the shuttle from one side of a weave to another side of the weave and from a first transfer element on a first machine side to a second transfer element on a second machine side of the shuttle weaving machine, wherein both of the first and second transfer elements are connected to the shuttle during a transfer period;

a left-hand connecting element for connecting the shuttle to the first transfer element and a right-hand connecting element for connecting the shuttle to the second transfer element;

at least one bobbin drive mounted to at least one of, the shuttle, the first transfer element, and the second transfer element; and a filling bobbin supplying a filling thread, wherein the at least one bobbin drive is configured to exert torque on the filling bobbin independent of the shuttle drive such that the bobbin drive causes acceleration of a dispensing of the filling thread from the filling bobbin in anticipation of acceleration of the shuttle.

2. The shuttle weaving machine according to claim 1, wherein the at least one bobbin drive is fixedly disposed on the shuttle such that the at least one bobbin drive is configured to be alternately transferred from one side of a weave to another side of the weave with the shuttle.

3. The shuttle weaving machine according to claim 1, wherein the at least one bobbin drive is one of an electrical servo drive, a pneumatic drive or a friction wheel drive.

4. The shuttle weaving machine according to claim 1, wherein the filling bobbin further comprises a yarn bobbin holder for receiving a standardized filling thread bobbin.

5. The shuttle according to claim 4, wherein a sleeve guiding device receives the yarn bobbin holder and passively transfers momentum in a coaxial direction.

6. The shuttle weaving machine according to claim 1, wherein a single drive is arranged on the shuttle for the filling bobbin.

7. The shuttle weaving machine according claim 1, wherein the at least one bobbin drive further comprises:

a first bobbin drive mounted to the first transfer element adjacent the left-hand connecting element such that the first bobbin drive moves translationally with the first transfer element into and out of engagement with the shuttle;

a second bobbin drive mounted to the second transfer element adjacent the right-hand connecting element such that the first bobbin drive moves translationally with the first transfer element into and out of engagement with the shuttle.

8. The shuttle weaving machine according to claim 1, wherein the connecting elements are embodied as a single slide having internally affixed guide bores aligned in the direction of the filling thread insertion for receiving a guiding element.

9. The shuttle weaving machine according to claim 1, wherein the bobbin drive impinges directly in a torque-controlled manner upon at least one of a friction wheel, an air rotor and a sleeve rotatably mounted to a shaft, the filling bobbin being mounted to the shaft and coupled to the at least one of the friction wheel, the air rotor, and the sleeve effective to be rotated thereby.

10. The shuttle weaving machine according to claim 9, wherein the friction wheel runs at least temporarily on a roller of the filling bobbin.

11. The shuttle according to claim 8, wherein a sleeve guiding device receives a yarn bobbin holder and passively transfers momentum in a coaxial direction.

12. The shuttle weaving machine according to claim 1, wherein for each connecting element a guiding element facing the shuttle with a stop is provided for the shuttle, and the shuttle is configured to a temporarily lock this stop after a gap has been passed, thereby facilitating a shed switch between the connecting elements in the direction of insertion of the filling thread.

13. The shuttle weaving machine according to claim 1, wherein the rotational axis of the filling bobbin is aligned with the direction of the warp thread.

14. The shuttle weaving machine according to claim 13, wherein the filling thread passes through a slot through a housing surrounding at least the filling bobbin for at least part of its circumference.

15. A weaving machine comprising:

a shuttle;

a shuttle drive configured to move the shuttle from one side of a weave to another side of a weave;

a filling thread bobbin mounted to the shuttle and configured to supply a filling thread, wherein the filling bobbin is arranged one of in alignment with the warp thread direction and perpendicular to the warp thread direction; and a bobbin drive configured to move translationally with the shuttle and selectively accelerate and decelerate rotation of the filling thread bobbin independent of acceleration of the shuttle.

16. The weaving machine according to claim 15, wherein a machine controller is configured to control the bobbin drive independently of the shuttle drive.

17. The weaving machine according to claim 16, wherein the machine controller is configured to control the bobbin drive as a function of the filling thread tension measured through the filling thread bobbin.

18. The weaving machine according to claim 16, wherein the machine controller is configured to control the bobbin drive as a function of preset travel and time.

19. A weaving process using a shuttle weaving machine to achieve a weave consisting of warp threads and filling threads, comprising:

moving, by shuttle drive, a shuttle having a filling thread bobbin mounted thereto from one side of the weave to another side of the weave;

controlling, by a bobbin drive engaging the filling bobbin, a filling thread tension independent of acceleration of the shuttle, the filling thread tension measured through the filling thread bobbin, the shuttle being controlled according to at least one of process data or fabric characteristics.

20. The weaving process according to claim 19, wherein the bobbin drive is controlled as a function of filling thread tension.

21. The weaving process according to claim 19, wherein the bobbin drive is controlled as a function of preset travel and time.

* * * * *